US005150116A

United States Patent [19]

West

[11] Patent Number: 5,150,116

[45] Date of Patent: Sep. 22, 1992

[54] TRAFFIC-LIGHT TIMED ADVERTISING CENTER

[76] Inventor: Harold B. West, 617 Ridgeland, Cheyenne, Wyo. 82009

[21] Appl. No.: 509,286

[22] Filed: Apr. 12, 1990

[51] Int. Cl.[5] ..... G08G 1/00

[52] U.S. Cl. ..... 340/928; 340/905; 340/908.1; 340/929; 40/453

[58] Field of Search ..... 340/928, 925, 905, 944, 340/929, 908.1; 11/11; 40/447, 452, 453

[56] References Cited

U.S. PATENT DOCUMENTS

| | | | |
|---|---|---|---|
| 3,210,728 | 10/1965 | Davis et al. | 340/928 |
| 3,226,707 | 12/1965 | Newman et al. | 340/486 |
| 3,299,553 | 1/1967 | Newman et al. | 340/485 |
| 3,320,585 | 5/1967 | Hines | 340/929 |
| 3,564,495 | 2/1971 | Gould et al. | 340/944 |
| 3,594,720 | 7/1971 | Cane | 340/925 |
| 3,750,138 | 7/1973 | Burgan et al. | 340/332 |
| 4,059,821 | 11/1977 | Nicholls | 340/925 |
| 4,954,822 | 9/1990 | Borenstein | 340/925 |

*Primary Examiner*—Donnie L. Crosland

*Attorney, Agent, or Firm*—Antonio R. Durando; Harry M. Weiss

[57] ABSTRACT

A traffic light timed advertising center includes an advertising display device, such as an electronic message center or other visual display device for displaying alpha-numeric and symbolic advertising messages, in which the advertising messages can be made selectively visible and invisible to drivers, is positioned adjacent a traffic control signal device having alternative signal phases for sequentially stopping and permitting the flow of traffic. A display control device, including an electronic control signal, coordinates the advertising display device with the traffic control signal device to make the advertising message invisible to drivers at selected times, particularly during transitions of the traffic control signal device from one signal phase to another, during a particular phase, and for predetermined time intervals before or after the transition from one phase to another, as desired or appropriate to display the advertising message only during times of the traffic control signal device phases when drivers' attentions to the advertising message will not adversely affect the drivers' attentions to required driving functions.

29 Claims, 4 Drawing Sheets

TRAFFIC-LIGHT TIMED ADVERTISING CENTER

TECHNICAL FIELD

The present invention relates broadly to signage and advertising displays and more specifically to a startable and stoppable advertising display device for use in association and in coordination with a traffic light.

BACKGROUND ART

Traffic lights have been with us for a long time. And, they, like automobiles, have gone from being an oddity and a rarity, at the beginning of this century, to being a virtual necessity. At the same time traffic lights have become increasingly complex. Integrating a traffic light into an entire traffic control system has necessitated interconnecting traffic signals electronically to properly coordinate vehicular and pedestrian traffic at specific intersections as well as to properly coordinate vehicle traffic between intersections.

Advertising displays directed to motorists to promote merchants' products and services are, of course, also very common, usually in the form of highway billboards, signage along streets, and store front displays. There are some very good reasons to combine advertising displays with traffic signals. For example, traffic control signals are usually placed at intersections where there is a high volume of vehicular traffic, so advertising at those same intersections would get exposed to many people, usually at times when the people can do little else other than to drive or ride in the vehicle. Revenues from the rental of such advertising space on traffic signals could be put to good use by local governments for road and street improvements or other desirable community improvements or expenditures. There may also be some very real benefits in providing advertising displays to occupy drivers' minds and attentions to decrease boredom and irritability while the wait at red lights or are stalled in congested traffic.

Unfortunately, there are also some safety concerns, as well as practical considerations, that have thus far prevented any wide-spread or even minimal general use of advertising displays in conjunction with traffic signals in the past. One of the most significant safety problems is that the advertising displays could tend to divert drivers' attentions from the traffic control signals and from observing surrounding vehicular and pedestrian traffic at busy intersections when their utmost attention to their driving is needed to avoid traffic congestion and even possible accidents. Also, the physical locations of many traffic signals adjacent, and often over, busy streets and walkways presents a problem in changing the advertising displays during normal business hours without impeding the flow of traffic.

There are a few examples of earlier attempts to combine advertising displays with traffic signals, which have never attained any significant use, probably because they did not solve the safety and practical problems discussed above. For example, U.S. Pat. No. 1,662,348, issued to G. Stricker in 1928, discloses a large, framed, box-like mounting structure that contains both set of red, amber, and green traffic signal lights and an illuminated advertising display. The advertising display portion of Stricker's apparatus contained a semi-transparent surface mask or screen having advertising printed thereon along with a set of back lights to illuminate the advertising mask or screen from behind. Stricker apparently tried to minimize the problem of diverting drivers' attentions from the stop, go, and caution messages intended to be conveyed by the conventional red, green, and amber traffic lights by providing corresponding red, green, and amber back lighting for illuminating his advertising displays. Unfortunately, such color-coordinated backlighting still presented the advertising to the drivers at all times. While the U.S. Pat. No. 2,503,574, issued to J. Allen in 1950, disclosed an advertising display that is positioned in sidewalk curbs rather than adjacent the vehicular traffic control lights, it presents the same kind of problem to both pedestrians and to drivers who are in a position to see such displays. In fact, this Allen device really exacerbates the safety problem, because it combines and makes the "STOP" and "GO" signals integral parts with the advertising message. Such combination could actually confuse people and camouflage the intended traffic control message in the advertising message, thus, losing, or at least diluting, the crisp significance of the traffic control message.

DISCLOSURE OF INVENTION

Accordingly, it is a general object of this invention to provide an advertising display located and coordinated with a traffic control signal in such a manner as to take advantage for advertising purposes of the high-volume, captive audience available at traffic light-controlled intersections, while eliminating the problems of diverting driver and pedestrian attentions away from the traffic control signal during times when they should be most attentive.

A more specific object of this invention is to provide a visual advertising medium adapted for positioning adjacent a traffic control signal with the capability of making the visual advertising medium visible and invisible at selected times corresponding with the particular traffic control signals being displayed at any particular time.

Another specific object of this invention is to provide a visual advertising medium adjacent and coordinated with a traffic control signal in such a manner that the advertising is visible only during selected time portions of the normal cycling of a particular traffic control signal being displayed.

Still another specific object of this invention is to provide a visual advertising medium adjacent a traffic control signal that is adapted for easily and quickly changing the advertising message displayed on the medium without significant interference with the flow of traffic in the vicinity.

Additional objects, advantages and novel features of the invention shall be set forth in part in the description that follows and in part will become apparent to those skilled in the art upon examination of the following, or may be learned by the practice of the invention. The objects and advantages of the invention may be realized and attained by means of the instrumentalities and in combinations particularly pointed out in the appended claims.

To achieve the foregoing, and other objects, and in accordance with the purpose of the present invention, as embodied and broadly described herein, the traffic light timed advertising center of this invention may comprise advertising display apparatus for use in conjunction with a traffic control signal, wherein the traffic control signal has a first phase for stopping the flow of traffic, such as, for example, a red light, and a second phase for permitting the flow of traffic, such as, for example, a green light. The advertising display apparatus includes an advertising display device, such as, for example, a computer controlled electronic message center, that is capable of displaying an advertising message and in which the advertising message can be made selectively visible and invisible to drivers of vehicles in the traffic flow being controlled by the traffic control signal. It also includes display control means, such as a suitable electronic control circuit, coordinated with the traffic control signal in such a manner that the advertising message is made visible to drivers only during appropriate phases of the traffic control signal when the advertising message displayed will not unduly distract the drivers' attention from his or her driving responsibilities, such as while the red light phase is actuated or while the green light phase is actuated, and is made invisible during times when the drivers' attention to their driving duties is paramount, such as during transitions from green light to red light phases or vice versa. It is also preferred that the display control means not actuate the advertising display, and thereby making it visible, for a predetermined time interval after a transition from one traffic signal light phase to another, such as after a change from green to red, to provide time for the drivers to adjust to the changed phase before being distracted by the advertising display. Similarly, the display control means may also be adapted to make the advertising message invisible for an appropriate time interval before a traffic signal phase transition to give the driver time to reorient his attention to driving duties to be prepared for the next impending phase shift. In addition to red and green light traffic control signals, this advertising display apparatus can be used with other kinds of traffic control signals, such as railroad crossing signals. Also, several alternatives to using a computer-controlled electronic message center display can be used to make the display selectively visible and invisible, such as alternately illuminating and unilluminating a fixed visual display which may or may not be behind darkened plexiglass, closable shutters over a fixed display, or a rotatable or moveable display.

BRIEF DESCRIPTION OF DRAWINGS

The accompanying drawings, which are incorporated herein and form a part of the specification illustrate preferred embodiments of the present invention and together with the description serve to explain the principles of the invention.

In the Drawings.

BEST MODES FOR CARRYING OUT THE INVENTION

Figure 1:
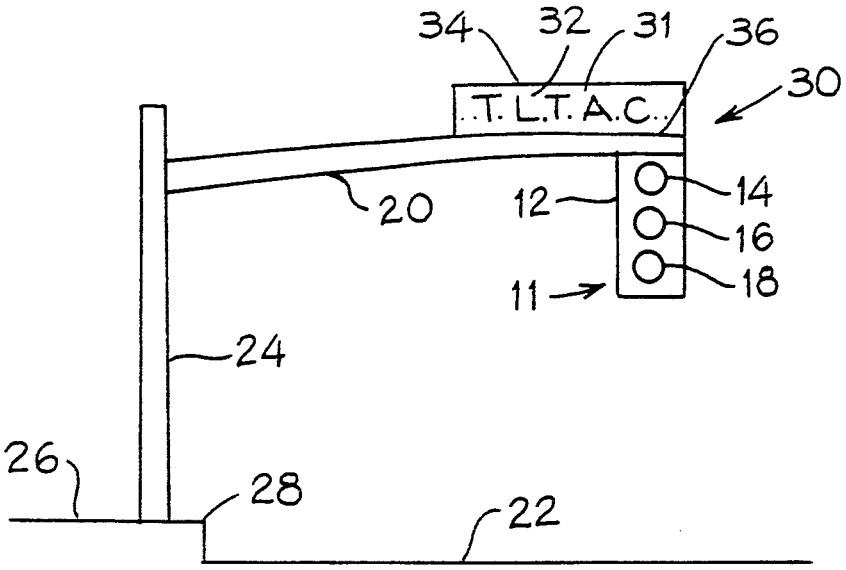
FIG. 1 illustrates the preferred embodiment of the present invention in the form of an alpha-numeric and symbolic advertising display in association with a typical traffic light.

The traffic light timed advertising center 10 of this invention is shown in FIG. 1, including a sign 30 containing an alpha-numeric and symbolic display 31 associated with a typical traffic light 11. Traffic light 11 is shown with a conventional light encasement or housing 12 and includes the conventional red light 14, amber or yellow light 16, and green light 18. An actuated red light 14, of course, is intended to convey a stop signal, an actuated yellow light 16 is intended to display a caution signal, and an actuated green light 18 is intended to display a proceed or go signal in the conventional manner. Of course, other conventional traffic signal lights, such as turn arrows, walk and don't walk lights, and the like (not shown) can also be used in conjunction with the traffic light timed advertising center of this invention. Encasement 12 of the traffic light 11 is typically suspended from a support arm 20 in the center of and over roadway 22. Support arm 20 is shown in a conventional manner supported by, and cantilevered from a vertical post 24, which is fixed to a sidewalk 26 at an intersection corner 28. Of course, the traffic light timed advertising center of this invention can also be used in conjunction with virtually any other conventional traffic light mountings, such as on a vertical pole, suspended from aerial cables, and the like (not shown).

Sign 30, which represents a preferred form of the visual advertising display medium of the traffic timed advertising center of this invention, is depicted in FIG. 1 as affixed to the top of support arm 20, although it can be located in any one of several convenient mounting locations associated with traffic light 11. Sign 30, for example, may alternatively be located below support arm 20 immediately adjacent encasement 12. Sign 30, as shown in FIG. 1, includes a face 32, a top surface 34 and a bottom surface 36, and a rear surface (not shown in FIG. 1).

In the preferred embodiment of the present invention, sign 30 may be, for example, an electronic message center, such as those commonly used for displaying advertising and other messages in other applications, such as at sporting events or commercial establishments, and the like. Such electronic message centers are well-known and usually comprise a two-dimensional array of a plurality of light-producing elements, each of which can be turned on and off separately by computer or microprocessor control. The computer or microprocessor can be programmed and reprogrammed to display any desired set of alpha-numeric displays, symbols, and the like in a variety of display formats, such as steady state, flashing on and off, or traveling along the length of the display, traveling vertically across the width of the display and it can be programmed to display a plurality of different messages or displays in any desired sequence and for selected time intervals. Such an electronic message center is preferred for use with this invention because of the speed and ease with which a given alpha-numeric and symbolic display 31 can be changed or turned on and off. Such changes in displays may be common in this application due to changes in advertising clients, or changes in the displays desired by advertising clients. Therefore, an advantage of using an electronic message center with this invention is that the advertising display can be programmed and changed instantly from a remote location. Also, it may be noted that other messages, such as public service announcements, may be displayed according to this invention in addition to commercial messages. Therefore, while the objects of this invention are directed primarily to commercial advertising uses, it may be understood that any other kind of message display is also appropriate. Thus, the term advertising is used for convenience in describing this invention, but advertising for purposes herein can also be construed to include any type of message display made according to this invention.

It may be preferred for safety and other reasons to not display any advertising on the sign 30 during certain traffic light signals or during transitions from one traffic signal to another. For example, it may be preferred to only display advertising during red lights when all vehicle traffic should be stopped, or perhaps only during green lights when all traffic should be flowing in a normal manner, and when advertising at the traffic light location would not be unduly distracting from the traffic signal being displayed. However, during transitions of traffic light signals, such as when the traffic light cycles from green to yellow to red or from red to green, when the drivers' attentions should be focused on the traffic signals, it may be preferable to not have any distracting visible advertising display on the sign 30. In fact, it may also be desirable to provide some time either before or after, or both before and after, such transitions in traffic signals to allow sufficient time for drivers to adapt their driving or stopping to the traffic signal or to anticipate an impending change in the traffic signal without distraction by an advertising display on sign 30. The traffic light timed advertising center of this invention, as described below, advantageously provides these options and capabilities.

Figure 2:
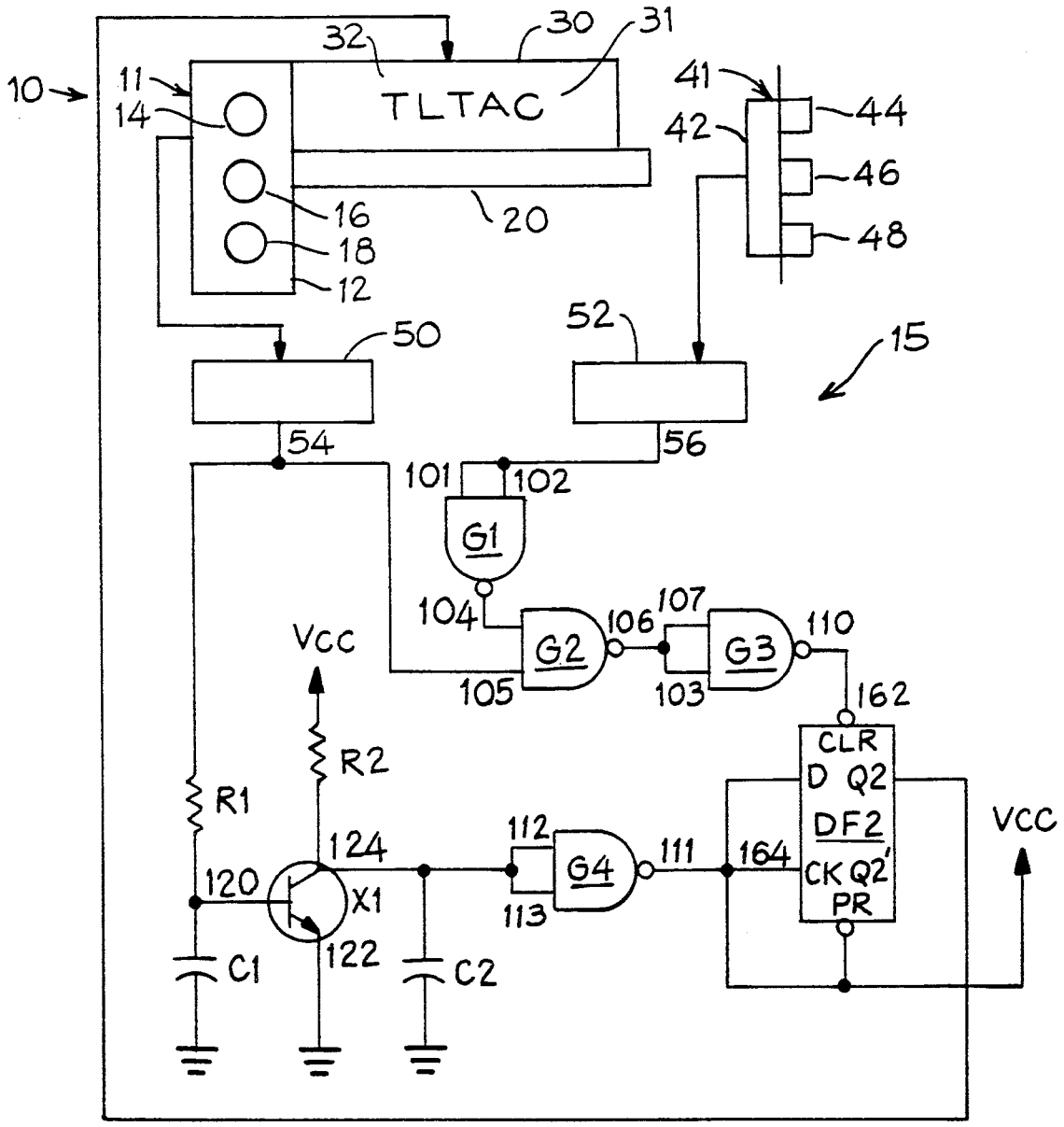
FIG. 2 shows a schematic of a timer circuit that can be used to time an alpha-numeric or symbolic advertising display in coordination with a traffic light signal according to this invention.

A sequential network 15 that can be used to restrict activation of display 31 solely to a particular light phase of the traffic light 11, such as solely to the red light phase is shown in FIG. 2. In this example, left traffic light 11 is considered to be the one that faces and is visible to oncoming traffic at an intersection, and a right traffic light 41 is considered to be facing cross traffic at the same intersection. Left traffic light 11 is the same traffic light 11 depicted in FIG. 1, with its casement 12, red light 14, yellow light 16 and green light 18. Right traffic light 41, similar to left traffic light 11, includes a casement 42, a red light 44, a yellow light 46, and a green light 48. This sequential network also includes a voltage converter 50 connected to left traffic light 11 and a voltage converter 52 connected to right traffic light 41. Outputs 54 and 56 of voltage converters 50 and 52, respectively, are digital, transmitting either a high or low potential to the remainder of the circuit. There are four Nand gates employed in this network, gates G1, G2, G3, and G4. These four Nand gates are typically found on a single IC chip, such as, for example, a 7400 quad two input Nand gate chip. The output 110 of Nand gate G3 which is the net result of Nand gates G1, G2, and G3, is connected to clearing input 162 of a D flip flop DF2. The output 111 of the gate G4 is connected to the clock input 164 of the D flip flop DF2. D flip flop DF2 may be any typical D flip flop commonly available, such as, for example, a 747 dual D flip flop with preset and clear. The sequential network also includes capacitors C1 and C2 and resistors R1 and R2. In this example resistors R1 and R2 have values of 50K Ω and 3.9K Ω respectively. Resistors R1 and R2 have a rating of one-half (½) watt with a five percent (5%) tolerance. Also, for this example, capacitors C1 and C2 have values of 220 μF and 0.03 μF, respectively. The values of resistors R1 and R2, and capacitors C1, and C2 are merely recommended values and for the purpose of example only. Resistor R1 and capacitor C1 form the connection between output 54 of voltage converter 50 and a base 120 of transistor X1. Transistor X1 is a typical NPN transistor, such as, for example, a 2N222. As already indicated, the values of resistor R1 and capacitor C1 can vary but were chosen for this example because of their RC time constant $\tau$ of 11, which results in a three second delay between the output 54 of voltage converter 50 and base 120 of transistor X1. Emitter 122 of transistor X1 is grounded to provide the requisite positive at base 120 in order for transistor X1 to conduct. Collector output 124 from transistor X1 supplies the dual inputs 112 and 113 of gate G4 via a capacitor C2. The purpose of capacitor C2 is to ground out any short negative pulses during the cycling of traffic lights 11 and 41, which would prematurely clock D flip flop DF2. For the purposes of this circuit a low level corresponds to 0 V and a high level and VCC correspond to +5VDC.

During operation, when left traffic light 11 activates red signal light 14 in a conventional manner, the output voltage 54 of voltage converter 50 changes to high, placing a high level at input 105 of gate G2. Concurrent to left traffic 11, activating red light 14, right traffic light 41 activates green light 48. With yellow light 46 and red light 48 being off, output 56 of voltage converter 52 is low. This low at output 56 communicates a low to dual inputs 101 and 102 of gate G1, resulting in a high level at output 104 of Gate G1. The high levels at both 104 and 105 results in a disabled clear input 162 of D flip flop DF2 via gates G2 and G3, thus enabling D flip flop DF2.

The high level output 54 of voltage converter 50 reaches base 120 of transistor X1 after approximately a 3 second delay resulting from the RC time constant $\tau$ developed by resistor R1 and capacitor C1. When base 120 finally goes high, transistor X1 conducts, clocking the D flip flop DF2 via collector 124 and gate G4. This activation of D flip flop DF2 changes its output state variable Q2 from its previous state Q2 equal to low to a current state Q2 equal to high. This puts a high level to the message center 30 which, in turn, activates display 31. In summary, initially alpha-numeric and symbolic display 31 of message center 30 is turned off. When left traffic light activates red light 14, corresponding to right traffic light 41 activating green light 48, alpha-numeric and symbolic display 31 is activated following approximately a 3 second delay.

When right traffic light 41 activates yellow light 46, output 56 from voltage converter 52 goes high. This high level at output 56 results in an enabled clear input 162 to D flip flop DF2 via gates G1, G2, and G3. This now cleared D flip flop DF2 restores state variable Q2 to low, thus turning off alpha-numeric and symbolic display 31 of message center 30. In summary, alpha-numeric and symbolic display 31 is turned off when right traffic light 41 activates yellow light 46, even though left traffic light 11 is still displaying a red light 14. Accordingly, alpha-numeric and symbolic display 31 is only displayed when left traffic light 11 is displaying a red light and right traffic light 41 is displaying a green light 48 following an initial delay of approximately 3 seconds.

Inputs 104 and 105 to gate G2 coming separately from output 54 of voltage converter 50, which is tied to left traffic light 11, and output 56 from voltage converter 52, which is tied to right traffic light 41 acts as a safety feature. If, for some reason, the activation of yellow light 46 of right traffic light 41 does not enable clear input 162 to the D flip flop DF2 turning off alpha-numeric and symbolic display 31 of message center 30, left traffic light 11 turning off red light 14 and activating green light 18 will. When red light 14 is turned off and green light 18 is activated, output 54 of voltage converter 50 goes low which also results in an enabled clear input 162 to D flip flop DF2, resulting in a low output state variable Q2 which turns off message center display 31.

Figure 3:
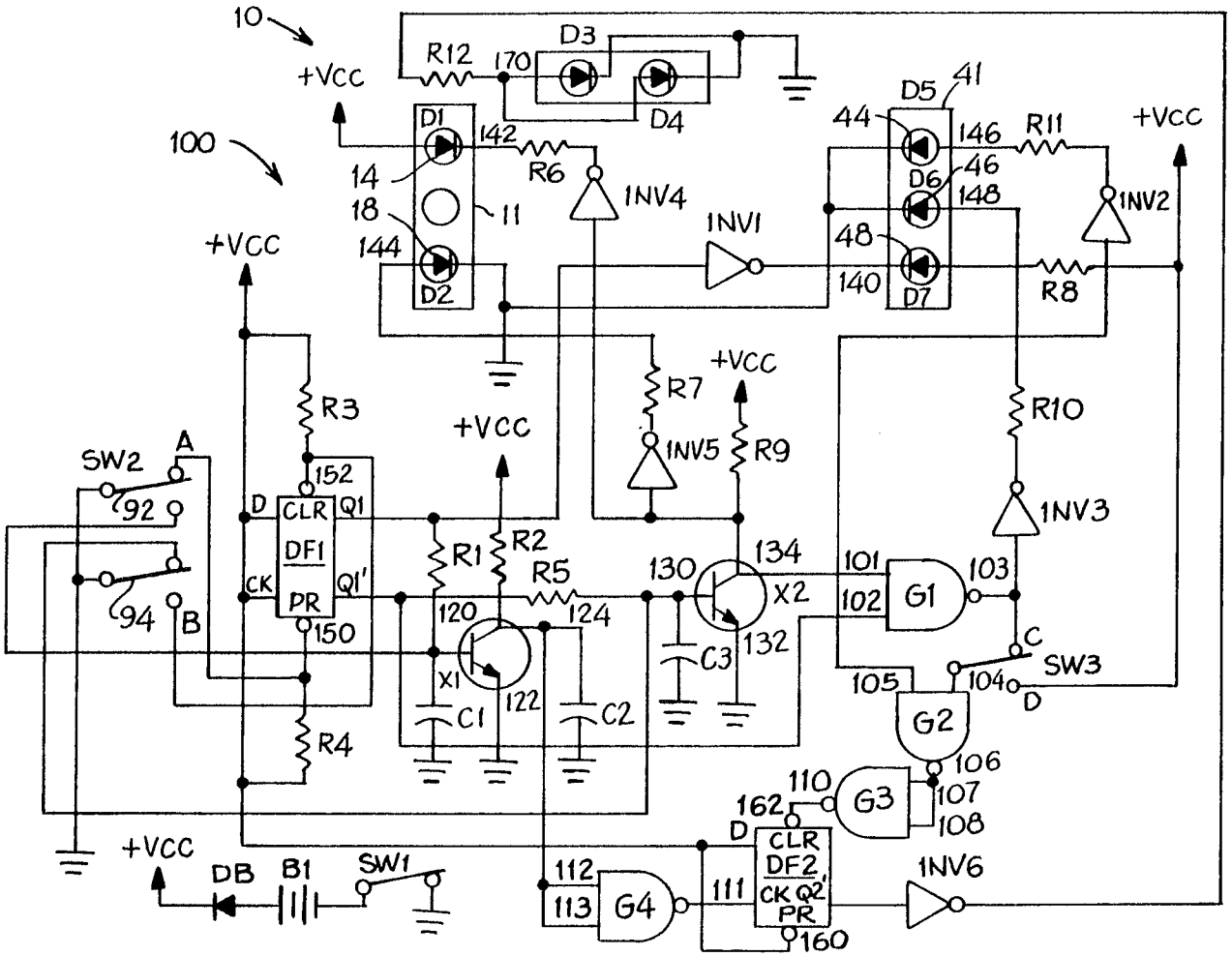
FIG. 3 shows a circuit diagram of a timer circuit that times the alpha-numeric or symbolic display from circuitry that controls a traffic light according to this invention.

A further method of timing display 31 to the cycling of a traffic light is to tie its activation to the same circuitry which controls the traffic light itself. To exemplify this method, a prototypic circuit 100 was developed as shown in FIG. 3. For the purpose of example, the traffic lights and the message center display were modeled by light emitting diodes (LED's) D1, D2, D3, D4, D5, D6, and D7. Left traffic light 11 was modeled with diode D1 representing the red light 14 and diode D2 representing the green light 18. For the purposes of this prototypic model, yellow light 16 was not represented as yellow light 16 does not effect display 31 of message center 30 facing the same direction as left traffic light 11. Right traffic light 41 was modeled with red light 44 being represented by diode D5, yellow light 46 being represented by diode D6, and green light 48 being represented by diode D7. Diodes D3 and D4 represent alpha-numeric and symbolic display 31 of message center 30 which is adjacent to and facing the same direction as left traffic light 11.

Prototype circuit 100, depicted in FIG. 3, contains most of those elements from sequential network 15, depicted in FIG. 2. For example, two-input Nand gates G1, G2, G3, and G4 are all the same as were depicted in FIG. 2. Similarly resisters R1 and R2, capacitors C1, and C2, transistor X1 and D flip flop DF2 are all the same as were depicted in FIG. 2. For prototypic circuit 100, voltage converters 50 and 52 have been replaced with the remainder of the circuitry depicted in FIG. 3. The remainder of elements shown in FIG. 3 include another capacitor C3, another D flip flop DF1, another transistor X2 and six (6) invertors INV1, INV2, INV3, INV4, INV5, and INV6. This prototypic circuit 100 may also include three switches SW1, SW2, SW3, and a battery B1 in series with a diode D8. Finally this prototypic circuit 100 is littered with a few additional odd resistors R3 through R12, having possible values as follows: R3=R4=1.2KΩ; R5=50KΩ; R6=R7=R8=R10=R11=R12=470 Ω; and, R9=2.2KΩ. All resistors have a rating of one-half (½) watt with a five percent (5%) tolerance. D flip flop DF1 may be the other half of the IC chip which contained D flip flop DF2, which was for the purpose of example, a 747 Dual D flip flop with preset and clear. Capacitor C3 may be a 100 μF capacitor. Transistor X1, like transistor X2, can be a 2N222. Invertors INV 1 throught INV 6 can be formed by a single IC chip, which may be, for example, a 7404 hex invertor. Switch SW2 is a double throw, double pole switch containing switching elements 92 and 94, whereas switches SW1 and SW3 are single throw switches. Diodes D1 through D7 may be, for example, 20 mA LED's. Diode D8 may be a IN34A. And battery B1 for this prototypic circuit 100 can be formed from 4 AA batteries at 1.5 V each.

Nand gates G3 and G4, with matching dual inputs are used in this prototypic circuit instead of two invertors, in order to make full utilization of the existing 1C chips before adding any additional chips to the design. The 7404 hex invertor chip contains 6 invertors, which have already been designated as invertors INV1 through INV6. The 7400 quad two input Nand gate chip contains 4 two-input Nand gates, which leaves 2 Nand gates available after utilization of 2 of these Nand gates as gates G1 and G2. Therefore, rather than adding an additional invertor chip which would ultimately be only partially utilized, and leaving the Nand gate chip 7400, also only partially utilized, the remaining 2 Nands gates were employed as inverting Nand gates G3 and G4 with matching dual inputs.

Initialization of prototypic circuit 100 begins with switch SW1 in the closed position and proceeds as follows. Switch SW2 begins in the upward or A position, which presets D flip flop DF1 causing its output state variable Q1 to go high. This high level at state variable Q1 gets inverted by invertor INV1 causing a low on the cathode side 140 of Diode D7, thereby allowing it to conduct and lighting diode D7 (green light 48). A high level at state variable Q1 means state Q1′ is low. A low from Q1′ cuts off transistor X2 by placing a low at its base 130, therefore keeping its collector output 134 high. This in turn lights Diode D1 (red light 14) by way of output 142 of invertor INV4 and resistor R6. This high level at collector 134 also forces the output 144 of invertor INV5 and resistor R7 to go to a low level, which turns off diode D2 (green light 18). Similarly, output 146 of invertor INV2 and resistor R11 is low, turning off diode D5 (red light 44). Input 101 to gate G1 is tied to the high at collector 134 and input 102 is connected to the low at state variable Q1′ from D flip flop DF1, accordingly output 103 from gate G1 is high. This puts a low at the anode side 148 of diode D6 by way of invertor INV3 and Resistor R10, which turns Diode D6 (yellow light 46) off. In summary, this first step of initialization has turned diode D1 (red light 14) on, diode D2 (green light 18) off, while diode D7 (green light 48) is on, and diode D5 (red light 44) and diode D6 (yellow light 46) are off.

In the next step of the initialization process switch SW2 is switched to the down or the B position changing the output state variables of D flip flop DF1 so that state variable Q1 is low and Q1′ is high. Q1′ being high places a high at base 130 of transistor X2 after approximately a two second delay, which is created by the RC time constant $\tau$ of resistor R5 and capacitor C3. Before transistor X2 begins to conduct due to high from state variable Q1′, Q1′ places this high level at input 102 of gate G1. This high at input 102, coupled with the high level that remains at collector 134 until transistor X2 begins to conduct, places a low at output 103, which gets further inverted through invertor INV3 and resistor R10 to produce a low at cathode side 148 of diode D6 (yellow light 46) causing it to light. The new low level at state variable Q1 from D flip flop DF1 turns off diode D7 (green light 48) via invertor INV1.

This temporary high level at both inputs 101 and 102 to gate G1 translates through gates G2 and G3 to a low clearing input 162 to the clear of D flip flop DF2. Accordingly state variable Q2' of D flip flop DF2 is high, thus delivering a low through INV6 and resistor R12, to input 170 of diodes D3 and D4 (message center display 31) thus turning diodes D3 and D4 off. In summary turning switch SW2 to position B has turned Diode D7 (green light 48) off and turned on Diode D6 (yellow light 46) on while turning off diodes D3 and D4 (message center display 31).

The final stage of the initialization process occurs when the high from the state variable Q1' finally reaches base 130 of transistor X2 following the two second delay created by capacitor C3 and resistor R5, causing transistor X2 to conduct. When transistor X2 conducts collector output 134 goes low causing diode D5 (red light 44) to turn on from output 146 of invertor INV2 and resistor R11. A similar result of collector output 134 going low is that diode D1 (red light 14) turns off from output 142 of invertor INV4 and resistor R6. Diode D2 (green light 18) is turned on from output 144 of invertor INV5 and resistor R7. Diode D6 is turned off by this low collector output 134 by placing a low level at input 148 of diode D6 (yellow light 46) through gate G1, invertor INV3 and resistor R10. During this change from diode D6 (yellow light 46) being lit to diode D5 (red light 44) being lit, diode D7 (green light 48) has remained off, being driven by the low state variable Q1 of D flip flop DF1 and not by collector output 134 from transistor X2.

Even though output 103 from gate G1 has been changed to low, the clearing input 162 to D flip flop DF2 remains in a low or clearing state due to the corresponding change to low in input 105 to gate G2. This keeps diodes D3 and D4 (message center display 31) turned off. In summary following a two second delay right traffic light 41 changes from yellow light 46 (diode D6) to red light 44 (diode D5), and left traffic light 11 changed from red light 14 (diode D1) to green light 18 (diode D2), while message center display 31 (diodes D3 and D4) remained off. This concludes the initialization process of prototypic circuit 100.

Once initialized prototypic circuit 100 is ready for operation as follows. Switch SW2 is again placed in position A which represents the illumination of red light 14 on traffic light 11, and illumination of green light 48 on traffic light 41. Switch SW2 in position A presets D flip flop DF1 resulting in state variable values Q1 high and Q1' low. Q1 high places a low at cathode side 140 of diode D7 (green light 48) via invertor INV1 causing it to conduct and thus lighting diode D7 (green light 48). Capacitor C3 is shorted to ground by switching element 94 of switch SW2 forcing base 130 of transistor X2 to go low, thus preventing transistor X2 from conducting and thereby maintaining collector output 134 at a high level. As already described above, when collector output 134 is at a high level, diode D1 (red light 14) is turned on by way of invertor INV4, and resistor R6, and diode D2 (green light 18) is turned off via invertor INV5 and resistor R7. Similarly, diode D5 (red light 44) is turned off by way of invertor INV2 and resistor R11, and diode D6 (yellow light 46) is turned off through gate G1, invertor INV3 and resistor R10 while, as covered directly above, diode D7 (green light 48) is lit. When diode D1 (red traffic light 14) turns on, diodes D3 and D4 (message center display 31) are also turned on following a three second delay. This approximate three second delay is caused by the RC time constant $\tau$ of resistor R1 and capacitor C1 delaying the high level at state variable Q1 from reaching base 120 of transistor X1. Once base 120 goes high, transistor X1 is allowed to conduct causing collector output 124 to go low, which changes state variables Q2 and Q2' of D flip flop DF2 by way of Gate G4. This places a low at Q2' and allows diodes D3 and D4 to conduct and therefore light via invertor INV6 and resistor R12. In summary, when switch SW2 is placed in the A position, red light 14 (diode D1) on the traffic light 11 is turned on, and green light 18 (diode D2) is turned off. Similarly, with respect to traffic light 41, green light 48 (diode D7) is turned on, while yellow light 46 (diode D6) and red light 44 (diode D5) are turned off. Following a three second delay message center display 31 (diodes D3 and D4) is turned on.

The next phase of operation occurs when switch SW2 is placed in the B position. Switch SW2 in position B initially represents a continued illumination of red light 14 on traffic light 11, and a transition from illumination of green light 48 to illumination of yellow light 46 on traffic light 41. After a time delay of approximately 2 seconds, switch SW2 in position B represents a transition from illumination of red light 14 to green light 18 on traffic light 11, and a transition from yellow light 46 to red light 44 on traffic light 41. Switch SW2 accomplishes this initial condition by first clearing D flip flop DF1 and thereby changing its state variables Q1 and Q1' so that Q1 is now low and Q1' is now high. This low level at Q1 places a high at the cathode side 140 of diode D7 (green light 48) by way of invertor INV1, thus preventing diode D7 from conducting. This high at cathode side 140 turns diode D7 (green light 48) off. Collector 124 of transistor X1 is immediately changed to a high level by its base 120 being grounded through switching element 92 of switch SW2. The high at collector 124 of transistor X1 removes the clocking input at clock input 111 of D flip flop DF2 via gate G4 by replacing a low at clock input 111.

The new high level at state variable Q1' of D flip flop DF1 is felt on base 130 of transistor X2 after an approximately a 2-second delay created by the RC time constant $\tau$ as created by resistor R5 and capacitor C3. A high level at base 130 of transistor X2 allows transistor X2 to conduct, thereby causing collector output 134 to go low. Prior to the lapse of this 2-second delay, at which time transistor X2 will conduct, output 103 of gate G1 temporarily goes low due to the high from state variable Q1' being transmitted to input 102 of gate G1. This temporary low at output 103 turns on diode D6 (yellow light 46) by way of invertor INV3 and resistor R10. The temporary low at output 103 also enables the clear input 162 of D flip flop DF2 via gates G2 and G3. This resets the state variables Q2 and Q2' of D flip flop DF2 causing state variable Q2' to go high, thus turning off diodes D3 and D4 (message center display 31) by way of invertor INV6 and resistor R12. In summary, when switch SW2 is switched to position B, for a brief 2 second period, yellow light 46 (diode D6) is turned on while green light 48 (diode D7) is turned off, and message center display 31 (diodes D3 and D4) is turned off, while left traffic light 11 remains unchanged with red light 14 (diode D1) on and green light 18 (diode D2) off.

After the lapse of the 2 seconds that it takes the high from state variable Q1' to reach base 130 of transistor X2, transistor X2 is allowed to conduct forcing collector output 134 low. This low at collector output 134 returns output 103 of gate G1 to its normal high thereby turning off diode D6 (yellow light 46) the change in output 103 causes a change in input 104 to gate G2; however, there is a corresponding change in input 105 to gate G2 to low such that the enabling input to clear input 162 of D flip flop DF2 is retained keeping message center display 31 turned off. The new low level at collector output 134 turns on diode D5 (red light 44) by way of invertor INV2 and resistor R11. Similarly, on left traffic light 11 diode D1 (red light 14) is turned off by way of invertor INV4 and resistor R6 and diode D2 (green light 18) is turned on by way of invertor INV5 and resistor R7. In summary, following the 2 second delay, right traffic light 41 is changed from illumination of yellow light 46 (diode D6) to illumination of red light 44 (diode D5), and left traffic light 11 is changed from illumination of red light 14 (diode D1) to illumination of green light 18 (diode D2), while message center display 31 (diodes D3 and D4) remains inactivated.

One cycle of the operation is now complete. So long as switch SW1 is left in the closed or power on position, switch SW2 will continue to produce the same results described above when changed between positions A and B. This switching SW2 between positions A and B, due to the time delays built into sequential network 100, represents the normally sequencing of traffic lights and an intersection.

It should be noted that switch SW3 can be used to bypass the output 103 of gate G1. When switch SW3 is in position C, output 103 of gate G1 becomes input 104 to gate G2. With switch SW3 in this position, prototypic circuit 100 operates as described above, wherein D flip flop DF2 is cleared, thus turning off message center display 31 (diodes D3 and D4), immediately upon the transition from the illumination of green light 48 (diode D7) to the illumination of yellow light 46 (diode D6). This means that even though red light 14 (diode D1) is still displayed on left traffic light 11, message center display 31 (diodes D3 and D4) is turned off due to illumination of yellow light 46 (diode D6) on right traffic light 41. However, when switch SW3 is switched to position D, the output 103 of gate G1 is bypassed, and input 104 to gate G2 is at a constant high level, being connected directly to +VCC. Therefore, collector output 134 of transistor X2 alone controls the clearing input 162 of D flip flop DF2 by way of input 105 to gate G2 and via gate G3. Essentially, this bypassing of the output 103, results in message center display 31 (diodes D3 and D4) remaining illuminated until collector output 134 of transistor X2 goes low following the approximate 2-seconds which yellow light 46 (diode D6) is illuminated. In other words, message center display 31 (diodes D3 and D4) remains illuminated until left traffic light 11 changes from the display of red light 14 (diode D1) to green light 18 (diode D2) and right traffic light 41 changes from display of yellow light 46 (diode D6) to red light 44 (diode D5).

It is to be understood that this prototypic circuit 100 is for the purpose of example only. In practice, this invention may employ four message centers 30, associated with four traffic lights, such as, for example, two left traffic lights 11 facing north and south direction at a typical intersection and two right traffic lights 41 facing east and west at a typical intersection. Accordingly, the circuitry disclosed will be necessarily more complex, but the principle will remain unchanged.

It should be further understood that once the principles of the present invention are understood that these hard-wired circuits, sequential network 15 and prototypic circuit 100, may be replaced with the appropriate microprocessor controller that still embodies the same principles.

Figure 4:
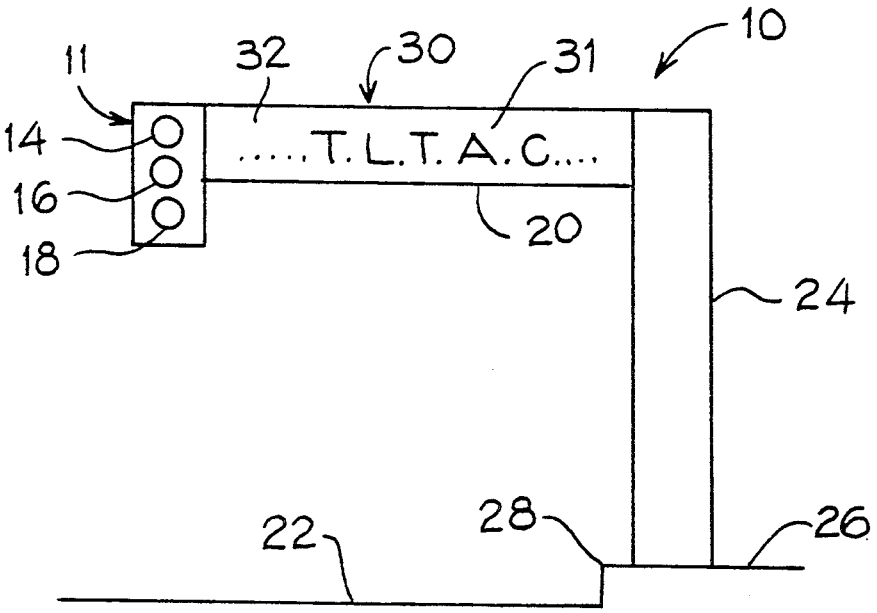
FIG. 4 shows an alternative embodiment of the present invention wherein the traffic light timed advertising center and the traffic light itself are incorporated into an integral, unitary electronic message center.

Another alternative embodiment, as seen in FIG. 4, incorporates a typical traffic light 11 into the same electronic message center as sign 30. In such an alternative embodiment, red light 14, yellow light 16, and green light 18 will merely appear as an additional message center display along with the advertising display 31 on message center 30.

One of the advantages of making sign 30 an electronic message center is that changes between one advertising messages 31 and another message 31, that would commonly result due to changes in advertising clients or changes in the desired display of a given advertising client may be accomplished from a remote location. Such changes in advertising message 31 can be programmed into a microprocess or computer controller (not shown) which controls message center 30. Advertising display 31 could then be changed instantaneously or by way of pre-programmed changes from a computer link to the controller of message center 30. This computer link may be by way of hard-wired (cable) link, modem type interface or other form of computer link-up. Such remote changes would speed up changing display 31, and would alleviate any traffic tie-ups which might result if actual physical contact with sign 30 were required to change display 31.

Although it is preferred that sign 30 be an electronic message center, this is not the only alternative. Sign 30, with reference back now to FIG. 1, may also be in the form of a fixed display, such as a painted sign, stenciled panel, lettered glass, or small billboard. If it is desired to only have display 31 visible during portions of the cycling of traffic light 11, illumination of sign 30 could be timed off of traffic light 11 such that it is illuminated, for example, only during the lighting of red light 14. Such illumination could be in the form of back lighting from behind display 31, top lighting from top surface 34, or bottom lighting from bottom 36 of sign 30. If it is desired to time the illumination means of display 31 on the cycling of the traffic lights 11 and 41, then this illumination means is modeled equally well by the sequential network 15 of FIG. 2, and by diodes D3 and D4 (display 31) in prototype circuit 100, seen in FIG. 3.

Figure 5:
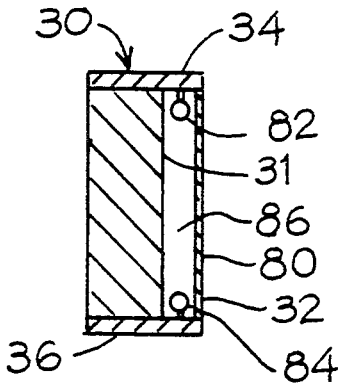
FIG. 5 shows a cross-sectional view of another alternative embodiment of the present invention in the form of a display located behind darkened plexiglass.

Expanding upon this idea of making display 31 alternatively visible and invisible by means of illumination, it is possible to place display 31 behind a darkened translucent plexiglass plate 80, placed at face 32, as seen in FIG. 5. In this embodiment, illumination may be accomplished by a system of lights, represented by lights 82 and 84. When lights 82 and 84 are not illuminated, darkening cavity 86, darkened plexiglass 80 shows a smooth dark, usually black, face, thereby making display 31 invisible. Conversely, when lights 82 and 84 are turned on, illuminating cavity 86, darkened plexiglass 80, allows display 31 to shine through, thereby making display 31 visible.

Figure 6:
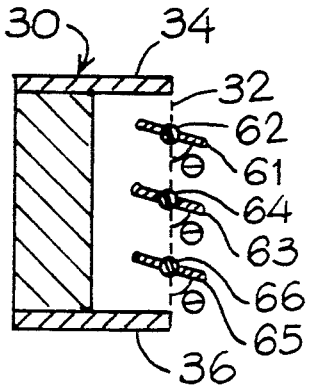
FIG. 6 shows a cross-sectional view of another alternative embodiment of the present invention in the form of a sign display located behind a system of shutters.
Figure 7:
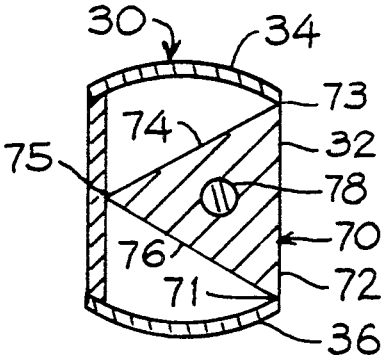
FIG. 7 illustrates a cross-section of another alternative embodiment of the present invention in the form of a rotatable cylinder.

Alternative methods of making display 31 alternatingly visible and invisible, include various mechanical means as seen in FIGS. 6 and 7. The mechanical visibility and invisibility means shown in FIG. 6 includes placing display 31 behind a system of rotatable shutters 61, 63, and 65. In FIG. 6, display 31 may be an electronic message center as in the preferred embodiment, or may be a fixed display, again in the form of a painted sign, stenciled panel, lettered glass, or a small billboard. Shutters 61, 63, and 65 are rotatable about shutter axes 62, 64, and 66, respectively. Rotation of shutter axes 62, 64, and 66 and, therefore, rotation of shutters 61, 63 and 65 may be controlled electronically. Rotation of shutter axes 62, 64, and 66, in a clockwise direction places shutters 61, 63, and 65 across face 32, which is indicated by a dashed line in FIG. 6. This shutter orientation corresponds to a closed position, effectively making display 31 invisible.

Contrariwise, full rotation of shutter axes 62, 64, and 66 in a counterclockwise direction corresponds to an open position by placing shutters 61, 63, and 65 at an angle $\theta$ to face 32. Angle $\theta$ will vary depending upon the intersection at which message center 30 is placed, but corresponds to the optimal angle for viewing by drivers stopped at a red light at that given intersection. If it is desired that shutters 61, 63, and 65, be open, thus making display 31 visible only during the red light phase of a traffic light, the sequential network 15 and the prototype circuit 100, shown in FIGS. 2 and 3 model this equally as well as the examples given above. In this embodiment, activation of diodes D3 and D4 of prototypic circuit 100 represent opening of shutters 62, 63, and 65, and deactivation of diodes D3 and D4 represent closing of shutters 61, 63 and 65.

The other additional embodiment of the present invention whereby the visibility and invisibility means of display 31 is accomplished by mechanical means is shown in FIG. 7. In this embodiment, the two dimensional, stationary display 31 of previously described embodiments has been replaced by a rotatable cylinder 70 of regular multi-sided cross-section, which may be, for example, a triangle as is depicted in FIG. 7. Triangle cylinder 70 is rotatable about its central axis 78 and contains surfaces 72, 74, and 76 connected at corners 71, 73, and 75. Rotation of cylinder 70 about its axis 78 may be controlled electronically. Such controlled rotation of cylinder 70 can, for example, selectively place any one of its surfaces 72, 74, or 76 in a position coplanar with face 32 of sign 30. Only one of the surfaces 72, 74, or 76 may be located at face 32 at any given time. In this embodiment top surface 34 and bottom surface 36 are necessarily curved to allow passage of corners 71, 73, and 75 as triangular cylinder 70 rotates about axis 78.

If it was desired to have an advertising display visible to drivers only during the red light cycle of a traffic light, then one of the surfaces of triangular 70, say for example, surface 72, may be a blank surface, while surfaces 74 and 76 may contain alternating advertising displays. It is possible to have triangular cylinder 70 rotate in alternating directions such that during one red light phase, advertising display surface 74 is displayed, then blank surface 72 can be displayed during the yellow and green light phases, and finally on the next red light phase the other advertising surface 76 can be displayed. Alternatively, it may be possible to have triangular cylinder 70 rotate continuously in one direction such that first advertising surface 74 may be displayed during the first half of a red light phase, then the second advertising surface 76 may be displayed during the second half of the red light phase, finally returning the triangular cylinder 70 to display blank surface 72 during the green light and yellow light phase of the traffic signal. Once again, if it is desired that this embodiment only display its advertising surfaces 74 and 76 during the red light phase of a traffic signal, the appropriate corresponding circuitry can be modeled by sequential network 15 and prototypic circuit 100, seen in FIGS. 2 and 3 with minimal modifications. Such modifications may include a simple binary counter or other means to alternate rotation of triangular cylinder 70, or incorporating the necessary delays to display one message for half of the red light cycle and the other message for the other half of the red light cycle.

While the embodiments described above show the advertising sign 30 associated with a typical fixed traffic light 11, it may also be used with other traffic control devices, such as mobile traffic signals, which are sometimes used to provide temporarily traffic control at sporting and entertainment events or to temporarily replace damaged traffic lights 11. In the case of mobile traffic signals, the alpha-numeric and symbolic advertising display 31 may include information about future sporting or entertainment events as well as timely information regarding traffic conditions and patterns.

Figure 8:
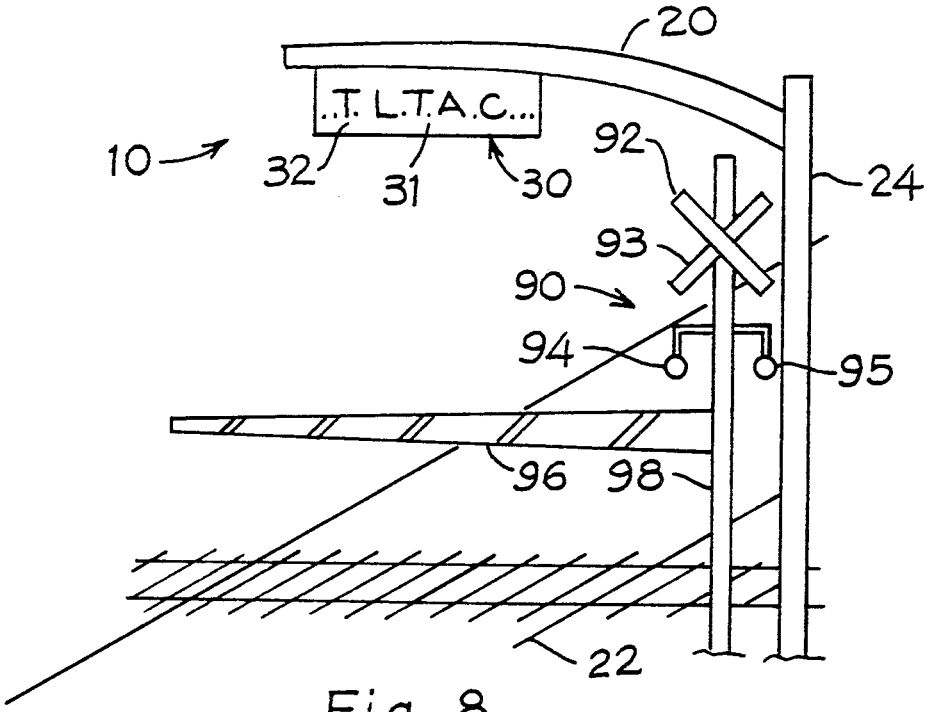
FIG. 8 illustrates the preferred embodiment of the present invention associated with a typical railroad crossing signal.

Sign 30 may also be used in conjunction with other forms of traffic control signals, such as, for example, railroad crossing warning signal 90, as shown in FIG. 8. Railroad crossing signal 90 is usually positioned just before and in front of a set of railroad tracks 88 crossing a roadway 22 and typically includes a pair of crossed railroad crossing signs 92 and 93 attached to a fixed post 98. Such railroad crossing signals 90 typically have a moveable barricade arm 96 and warning lights 94 and 95. As shown in FIG. 8, sign 30, which may be of any of the types described above, but is preferable an electronic message center, may be suspended from support arm 20. Placing sign 30 up above barricade 96 makes display 31 visible to several rows of drivers stopped at railroad crossing signal 90; and, centering sign 30 over roadway 22, increases the likelihood of display 31 capturing the attention of those drivers who are waiting at railroad crossing signal 90. However, sign 30 may be located any number of places associated with railroad crossing signal 90. Support arm 20 may be held up and over roadway 22 by vertical post 24 which is located near and in association with railroad crossing signal post 98. Activation of alpha-numeric and symbolic display 31 may be timed such that it is activated and thus made visible when barricade arm 96 is lowered and warning lights 94 and 95 are flashing, thus restricting the flow of traffic. In addition to being informative, sign 30 located at a railroad crossing may offer welcome distraction and relief at the long waits typically associated with railroad crossings.

Accordingly, a product and process have been provided which demonstrate alpha-numeric and symbolic displays in the form of advertising or public information message which incorporate convenient display, ease in changing of the message and efficiency in exchanging a given displayed message for another.

The foregoing is considered as illustrative only of the principles of the invention. Further, since numerous modifications and changes will readily occur to those skilled in the art, it is not desired to limit the invention to the exact construction and operation shown and described herein, and accordingly, all suitable modifications and equivalence may be restored to falling within the scope of the invention as defined by the claims which follow.

INDUSTRIAL APPLICABILITY

The present invention, according to its nature, and as described herein can be produced by the electrical/mechanical industry.

The embodiments of the invention in which an exclusive property or privilege is claimed are defined as follows:

1. A variable message advertising display apparatus combined with a traffic control signal device positioned adjacent a street, comprising:

a traffic control signal device consisting of multiple sets of traffic lights each facing a direction of traffic and each having a first phase for stopping the flow of traffic and a second phase for permitting the flow of traffic on the street;

a variable message advertising display means mounted adjacent to each of said multiple sets of traffic lights of the traffic control signal device in line of sight visible to drivers and passengers of vehicles in the flow of traffic being controlled by the traffic control signal device, said advertising display means being capable of displaying an advertising message and of having said advertising message made selectively visible and invisible to the drivers and passengers of the vehicles;

display control means connected to said advertising display means and to said traffic control signal device for automatically and selectively actuating and deactuating the advertising display means such that the advertising message is made visible and invisible, said display control means comprising digital logic gates connected to a flip-flop multivibrator for actuating and deactuating said advertising display means as a function of the phase of operation of the corresponding set of traffic lights; and electronic programming means connected to said display control means and said advertising display means for automatically and selectively changing the advertising message according to a predetermined display schedule chosen by a user.

2. The advertising display apparatus of claim 1, wherein said display control means is coordinated with the traffic control signal to actuate the advertising display means in such a manner as to make the advertising message invisible during transitions from one phase of the traffic control signal to another.

3. The advertising display apparatus of claim 2, wherein said display control means is coordinated with the traffic control signal to delay actuation of the advertising display means for a predetermined time interval after transition of the traffic control signal from one phase to another so as to keep the advertising message invisible to drivers for said predetermined time interval before it is made visible after the transition.

4. The advertising display apparatus of claim 2, wherein said display control means is coordinated with the traffic control signal to actuate the advertising display means to make the advertising message invisible a predetermined time prior to a transition of the traffic control signal from one phase to another.

5. The advertising display apparatus of claim 2, wherein said display control means is coordinated with the traffic control signal to actuate the advertising display means to make the advertising message visible only during a portion of a signal phase of the traffic control signal and invisible for the beginning portion of that phase and for the ending portion of that phase.

6. The advertising display apparatus or claim 3, wherein the actuation of the advertising display means is delayed for a predetermined time interval at the beginning of said first phase of the traffic control signal.

7. The apparatus of claim 1, wherein said traffic control device is an integral part of said variable message advertising display, so that a traffic control signal merely constitutes an additional message on said variable message advertising display.

8. A variable message apparatus, electrically connected to and synchronized with a traffic control device, for displaying an alpha-numeric and symbolic display for disseminating information to oncoming traffic, comprising a display visibility means automatically controlled in such a way that the alpha-numeric and symbolic display may at times be visible and at other times may be effectively made invisible, and wherein said display visibility means is electronically programmed in such a way that the alpha-numeric and symbolic display may be automatically and selectively changed according to a predetermined display schedule chosen by a user.

9. The apparatus of claim 8, wherein said display visibility means is tied to the traffic control device in such a manner that when the traffic control device has restricted a flow of traffic, the alpha-numeric and symbolic display is made visible, and when the traffic control device permits the flow of traffic the alpha-numeric and symbolic display is effectively made invisible.

10. The apparatus of claim 8, wherein the traffic control device is a fixed traffic light for the control of vehicular traffic located at a specific site along a roadway.

11. The apparatus of claim 8, wherein the traffic control device is a mobile traffic light for the temporary control of vehicular traffic.

12. The apparatus of claim 8, wherein the traffic control device is a railroad crossing gate.

13. The apparatus of claim 8, wherein the alpha-numeric and symbolic display is generated by a programmable electronic message center and the display visibility means is derived from activating and deactivating the message center, such that the display is made visible by activating the message center and the display is made invisible by deactivating the message center.

14. The apparatus of claim 13, wherein the traffic control device is an integral part of the electronic message center such that a traffic control signal merely forms as an additional display on the message center.

15. The apparatus of claim 8, wherein the display visibility means includes positioning the alpha-numeric and symbolic display behind at least one shutter, such that the display is made invisible by placing the shutter across and in front of the display and the display is made visible by at least partial remove of the shutter from a position across the front of the display.

16. The apparatus of claim 8, wherein the display visibility means includes locating the alpha-numeric and symbolic display on a rotatable cylinder of regular multi-side cross-section, such that the display is made invisible by rotation of said rotatable cylinder to a blank surface and the display is made visible by rotation of said rotatable cylinder to a non-blank surface.

17. A method of displaying a variable alpha-numeric and symbolic message on a variable-message advertising display comprising the steps of:

electrically connecting the display to and synchronizing it with a traffic control device; and programming the display in such a way that the alpha-numeric and symbolic display may be automatically and selectively changed according to a predetermined display schedule chosen by a user.

18. The method of claim 17, including the additional step of fitting the display with a display visibility means such that alpha-numeric and symbolic display may at times be visible and at other times may be effectively made invisible.

19. The method of claim 18, wherein the display visibility means is tied to the traffic control device, such that when the traffic control device has restricted a flow of traffic, the alpha-numeric and symbolic display is made visible, and when the traffic control device permits the flow of traffic the alpha-numeric and symbolic display is effectively made invisible.

20. The method of claim 18, wherein the alpha-numeric and symbolic display is generated by a programmable electronic message center and the display visibility means is derived from activating and deactivating the message center, such that the display is made visible by activating the message center and the display is made invisible by deactivating the message center.

21. The method of claim 20, wherein said traffic control device is an integral part of said variable message advertising display, so that a traffic control signal merely constitutes an additional message on said variable message advertising display.

22. The method of claim 18, wherein the display visibility means includes positioning the alpha-numeric and symbolic display behind at least one shutter, such that the display is made invisible by placing the shutter across and in front of the display and the display is made visible by at least partial removal of the shutter from a position across the front of the display.

23. The method of claim 18, wherein the display visibility means includes locating the alpha-numeric and symbolic display on a rotatable cylinder of regular multi-sided cross-section, such that the display is made visible by rotation of said rotatable cylinder to a blank surface and the display is made visible by rotation of said rotatable cylinder to a non-blank surface.

24. An apparatus for a traffic-control-signal variable message advertising display combination for use adjacent a street, comprising:

an electronic message center, including a two-dimensional array of a plurality of light-producing elements, each of which can be turned on and off separately, said two-dimensional array being capable of forming alpha-numeric advertising messages and graphic symbols constituting traffic control signals comprising a first phase for stopping the flow of traffic and a second phase for permitting the flow of traffic on the street;

a programmable microprocessor connected to said electronic message center for automatically activating the sequence of traffic control signals for said first and second phase of traffic flow and for controlling the display of any desired set of alpha-numeric advertising messages in a variety of display formats by actuating said plurality of light-producing elements according to a predetermined sequence chosen by a user; and a sequential network connected to said electronic message center and to said programmable microprocessor for automatically enabling and restricting the activation of said plurality of light-producing elements to particular light phases of the traffic control signals.

25. The advertising display apparatus of claim 24, wherein said sequential network actuates said programmable microprocessor in such a manner as to make the advertising message invisible during transitions from one phase of the traffic control signals to another.

26. The advertising display apparatus of claim 24, wherein said sequential network delays actuation of said programmable microprocessor for a predetermined time interval after transition of the traffic control signals from one phase to another so as to keep the advertising message invisible to drivers for said predetermined time interval before it is made visible after the transition.

27. The advertising display apparatus of claim 25, wherein said sequential network actuates said programmable microprocessor to make the advertising message invisible a predetermined time prior to a transition of the traffic control signals from one phase to another.

28. The advertising display apparatus of claim 25, wherein said sequential network actuates said programmable microprocessor to make the advertising message visible only during a portion of a signal phase of the traffic control signals and invisible for the beginning portion of that phase and for the ending portion of that phase.

29. The advertising display apparatus of claim 25, wherein the actuating of said programmable microprocessor is delayed for a predetermined time interval at the beginning of said first phase of the traffic control signals.

* * * * *